US006027434A

United States Patent [19]

Gibbons

[11] Patent Number: 6,027,434

[45] Date of Patent: Feb. 22, 2000

[54] DEVICE FOR RELIEVING LEG CRAMPS

[76] Inventor: Thomas J. Gibbons, 117 Primrose La., North Syracuse, N.Y. 13212

[21] Appl. No.: 09/192,479

[22] Filed: Nov. 16, 1998

[51] Int. Cl.[7] ..... A63B 21/002

[52] U.S. Cl. ..... 482/131; 482/140; 482/907; 482/91

[58] Field of Search ..... 482/131, 140, 482/907, 91; 135/65–68

[56] References Cited

U.S. PATENT DOCUMENTS

| | | | |
|---|---|---|---|
| D. 209,759 | 1/1968 | Snyder | D34/5 |
| 5,004,228 | 4/1991 | Powers | 272/125 |
| 5,230,679 | 7/1993 | Olsen | 482/91 |
| 5,292,295 | 3/1994 | Gerlach | 482/92 |
| 5,518,486 | 5/1996 | Sheeler | 482/131 |
| 5,662,562 | 9/1997 | Wohlenberg | 482/91 |
| 5,674,163 | 10/1997 | Sennett | 482/125 |
| 5,725,463 | 3/1998 | Colonello et al. | 482/140 |
| 5,776,083 | 7/1998 | Jacob et al. | 601/23 |

FOREIGN PATENT DOCUMENTS

| | | | |
|---|---|---|---|
| 94/04227 | 3/1994 | WIPO | 482/140 |

*Primary Examiner*—Richard J. Apley
*Assistant Examiner*—Lori Baker
*Attorney, Agent, or Firm*—Trapani & Molldrem

[57] ABSTRACT

A device for relieving leg cramps, which is comprised of a shaft, a handle at a proximal end of the shaft, and a stirrup attaching to a distal end of the shaft. The device is comprised of rigid, lightweight, plastic tubing and is detachable and portable for the safety, comfort and convenience of the user. While lying in a supine position, e.g. in bed, a user experiencing a leg cramp (or charley horse) extends the affected leg, places the stirrup of the device over the toes so that the cushion covering the transverse bar bears against the sole of the foot. The user then pulls the handle proximally to pull the foot upwards and hyper-extend the cramped muscles until the cramp is relieved. Assistance of another person is rendered unnecessary.

8 Claims, 1 Drawing Sheet

DEVICE FOR RELIEVING LEG CRAMPS

BACKGROUND OF THE INVENTION

This invention relates to muscle pain palliative devices. More specifically, the invention relates to a cramp-relieving device that may be employed by the affected person while in bed.

Leg cramps, in particular cramps in the calf, frequently occur while a person is lying in bed. The usual method of self-relief is to get out of bed and, while standing, bear onto the toes of the affected leg to extend the calf muscle until the cramp is relieved. In another method, a partner grasps the foot and presses the sole and toes back; however, it is not always possible or convenient to find someone to do this.

While there are exercise devices available, none suggest that they may be used for any therapeutic purpose other than exercise.

OBJECT AND SUMMARY OF THE INVENTION

It is an object of the present invention to provide a device that allows a person who is in bed and who has a leg cramp to relieve cramp without rising from bed, and without the assistance of another person.

It is another object to provide a device that is comprised of a rigid, lightweight material to reduce the risk of discomfort or injury to the user.

It is yet another object to provide a device that is portable, small enough to be kept near the bed, and safe to use.

Accordingly, a device is provided for relieving leg cramps, that the user may apply to the affected leg without assistance and without having to get up from bed. The device comprises a shaft, a T-shaped handle at a proximal end of the shaft, and a stirrup a stirrup having a transverse bar member attaching to a distal end of the shaft and support members each attaching to a respective end of the transverse bar member, made of rigid, lightweight plastic material. Alternatively, the shaft can be metal tubing. A portion of said stirrup may be covered with cushion on the portion where the sole of the foot is placed. In operation, a user places the stirrup over the toes of the cramped leg and pulls the handle proximally until the cramp is relieved. The lightweight character of the device allows for ease of operation and places minimal strain on the user. Since the device is also small and portable, it may be stored next to the bed for a user's convenience.

The above and many other objects, features, and advantages of this invention will become apparent from the ensuing description of a preferred embodiment, which should be read in connection with the accompanying Drawing.

DETAILED DESCRIPTION OF THE PREFERRED EMBODIMENT

Figure 1:
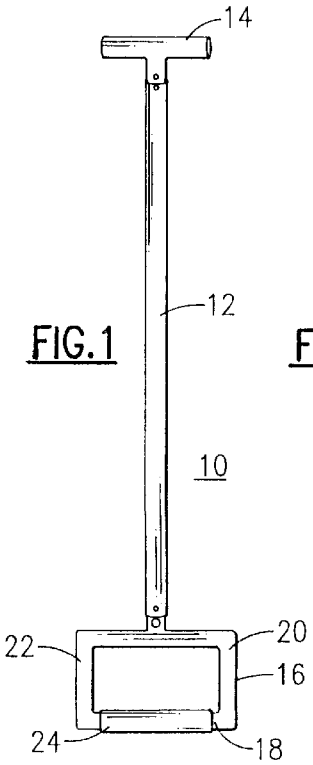
FIG. 1 is a view of a device for relieving leg cramps according to an embodiment of this invention.

FIG. 1 shows a view of one embodiment of a device 10 for relieving leg cramps. The device 10 is comprised of a shaft 12, a T-shaped handle 14 at a proximal end of the shaft 12, and a stirrup 16 attached to a distal end of the shaft 12. The stirrup 16 has a transverse bar member 18 with left and right support members 20, 22 that connect between the shaft 12 and respective ends of the transverse bar member 18. The transverse bar member 18 may have a cushion 24 covering the portion where the sole of the foot is placed.

Figure 2:
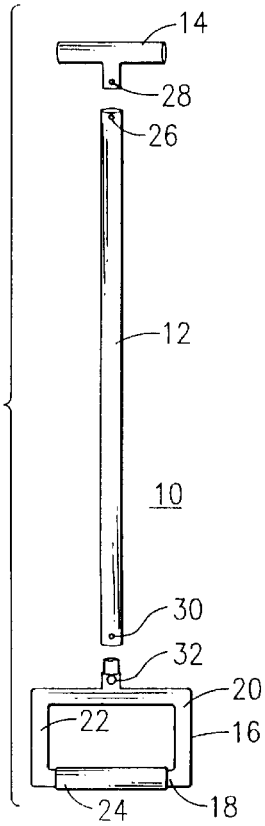
FIG. 2 is an exploded view of the device of FIG. 1.

FIG. 2 is an exploded view of the device 10 of FIG. 1. The device 10 is comprised of a T-shaped handle 14, a shaft 12, and a stirrup 16, as aforesaid. The T-shaped handle 14 fits removably over the proximal end of the shaft 12 and is secured into place by a push-spring detente 26 on the shaft 12 that locks into a small hole 28 on the T-shaped handle 14. The stirrup 16 fits removably over the distal end of the shaft 12 and is secured into place by a push-spring detente 30 on the shaft 12 that locks into a small hole 32 on the stirrup 16. The handle 14, shaft 12, and stirrup 16 of the cramp-relieving device 10 can each comprise rigid, lightweight tubing. A durable plastic tubing may be satisfactory and achieves safety, comfort, and convenience. Alternatively, metal tubing can be used. The portability and detachability of the device 10 make it especially well suited to be stored near the bedside and to be packed for travel.

Figure 3:
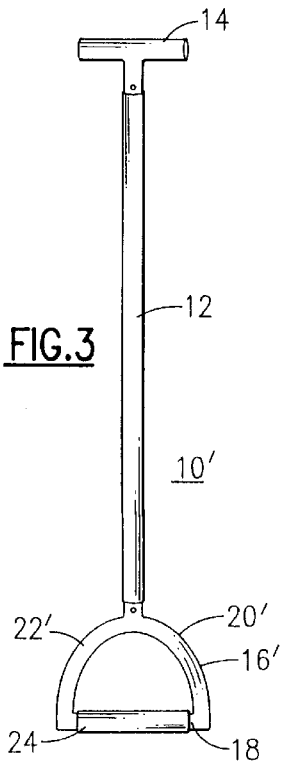
FIG. 3 is a view of a device according to a second embodiment.

FIG. 3 shows a view of a second embodiment of the cramp-relieving device 10'. The device 10' is comprised of a shaft 12, and a T-shaped handle 14 at a proximal end of the shaft 12, similar to the embodiment shown in FIG. 1. Here, there is a stirrup 16' attached to a distal end of the shaft 12. The stirrup 16' has a transverse bar member 18 with curved left and right support members 20', 22' that connect between the shaft 12 and respective ends of the transverse bar member 18, with a cushion 24. Besides the stirrups 16 and 16', other shapes are possible.

Figure 4:
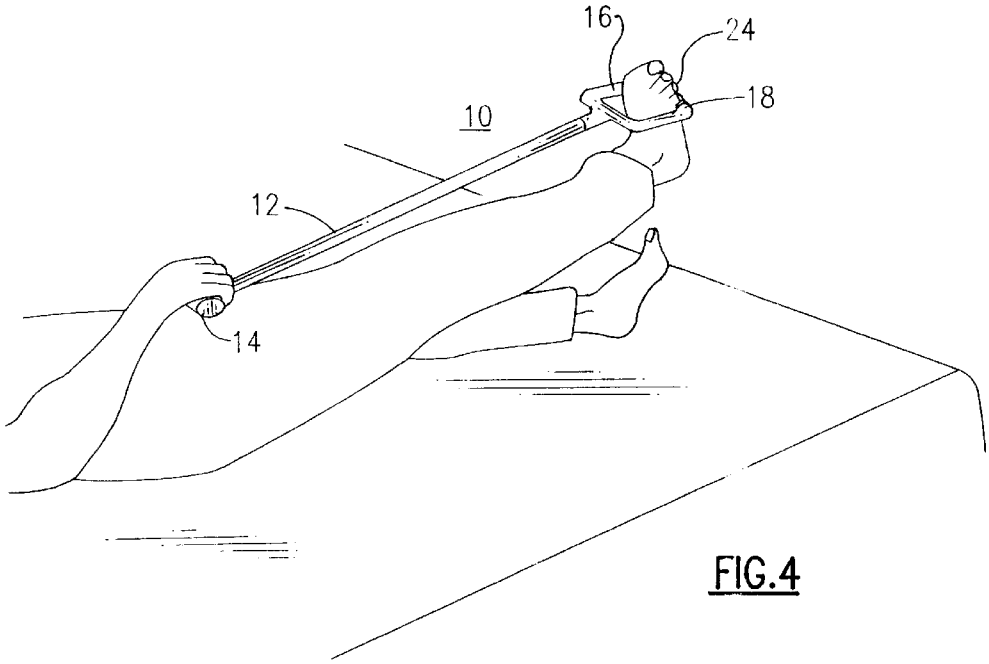
FIG. 4 is a view of a person employing the device.

Employment of the cramp-relieving device 10 can be explained with reference to FIG. 4. While lying in a supine position, e.g. in bed, a user experiencing a leg cramp (or charley horse) extends the cramped leg, places the stirrup 16 of the device 10 over the toes so that the transverse bar member 18 bears against the sole of the foot. The user then pulls the handle 14 proximally to pull the foot upwards and hyper-extend the cramped muscle(s) until the cramp is relieved. Assistance of another person is usually unnecessary.

While the invention has been described with reference to two embodiments, it should be recognized that the invention is not limited to those precise embodiments. Rather, many modifications and variations will be apparent to persons skilled in the art without departing from the scope and spirit of this invention, as defined in the appended claims.

I claim:

1. A device for relieving leg cramps, which device comprises: a shaft, a generally T-shaped handle at a proximal end of the shaft, and a single stirrup at a distal end of the shaft, said stirrup being centeredon said shaft, and said stirrup having a transverse bar member at a bottom of the stirrup adapted to/receive and engage a foot of a cramped leg, and left and right support members each attaching to a respective end of the transverse bar member and each rising therefrom and joined to the distal end of said shaft, said stirrup lying in a plane and being adapted to fit over the toes of said foot of the cramped leg; wherein said handle is coplanar with the stirrup.

2. A device as set forth in claim 1, wherein said shaft comprises rigid, lightweight tubing.

3. A device as set forth in claim 1, wherein said handle comprises rigid, lightweight tubing.

4. A device as set forth in claim 3, further comprising means for removably attaching said handle to said shaft.

5. A device as set forth in claim 1, wherein said stirrup includes rigid, lightweight tubing.

6. A device as set forth in claim 5, wherein said stirrup further includes a cushion covering a portion of said tubing.

7. A device as set forth in claim 6, further including means for removably attaching said stirrup to shaft.

8. A device as set forth in claim 1 wherein both said handle and said stirrup are detachable from said shaft.

* * * * *

UNITED STATES PATENT AND TRADEMARK OFFICE

CERTIFICATE OF CORRECTION

PATENT NO. : 6,027,434

DATED : Feb. 22, 2000

INVENTOR(S) : Thomas J. Gibbons

It is certified that error appears in the above-indentified patent and that said Letters Patent is hereby corrected as shown below:

In Col. 1, Line 35:

"a stirrup a stirrup" should read --a stirrup--.

In Col. 2, Line 55:

"to/receive" should read --to receive--.

Signed and Sealed this

Third Day of April, 2001

*Attest:*

Nicholas P. Godici

NICHOLAS P. GODICI

*Attesting Officer*

*Acting Director of the United States Patent and Trademark Office*